United States Patent [19]

Cross et al.

[11] Patent Number: 4,895,491

[45] Date of Patent: Jan. 23, 1990

[54] FAN BLADE PROTECTION SYSTEM

[75] Inventors: Steven R. Cross, Catonsville; Stuart J. Pass; Robert G. Huntington, both of Owings Mills, all of Md.

[73] Assignee: Environmental Elements Corp., Baltimore, Md.

[21] Appl. No.: 208,098

[22] Filed: Jun. 17, 1988

[51] Int. Cl.[4] ..... F04D 29/38

[52] U.S. Cl. ..... 416/224; 29/156.8 R; 244/123

[58] Field of Search ..... 416/224; 29/156.8 R, 29/156.8 B, 156.8 H, 156.8 P, 156.8 T, 526.2, 448; 244/123.124

[56] References Cited

U.S. PATENT DOCUMENTS

| | | | |
|---|---|---|---|
| 1,842,178 | 1/1932 | Kempton | 416/224 |
| 2,431,184 | 11/1947 | Martin | 416/224 |
| 4,097,193 | 6/1978 | Brunsch et al. | 416/224 |
| 4,667,906 | 5/1987 | Suarez et al. | 244/124 |
| 4,728,262 | 3/1988 | Marshall | 416/224 |
| 4,738,594 | 4/1988 | Sato et al. | 416/224 |

FOREIGN PATENT DOCUMENTS

| | | | |
|---|---|---|---|
| 697349 | 9/1940 | Fed. Rep. of Germany | 416/224 |
| 505912 | 11/1919 | France | 416/224 |
| 165778 | 12/1958 | Sweden | 416/224 |
| 163896 | 9/1964 | U.S.S.R. | 416/224 |
| 284623 | 1/1971 | U.S.S.R. | 416/224 |
| 2039526 | 8/1980 | United Kingdom | 416/224 |

*Primary Examiner*—Robert E. Garrett
*Assistant Examiner*—John T. Kwon
*Attorney, Agent, or Firm*—Morton J. Rosenberg; David I. Klein

[57] ABSTRACT

A fan blade protection system (100) is provided for substantially preventing erosion by particulate impingement on the fan blade. Fan blade protection system (100) includes an outer erosion resistant layer (110) laminately bonded to an elastomeric energy dissipative layer (120). The laminate structure of fan blade protection system (100) is bonded to a portion (12) of fan blade (10). The outer erosion resistant layer (110) is formed of a material having a high yield strength such that it elastically deforms on impact by high velocity particulates. The energy transferred to the outer erosion resistant layer (110) is absorbed and distributed by the elastomeric energy dissipative layer (120), minimizing the force transmitted to the surface of the fan blade.

20 Claims, 5 Drawing Sheets

FAN BLADE PROTECTION SYSTEM

BACKGROUND OF THE INVENTION

1. Field Of The Invention

This invention directs itself to fan blade protection systems. In particular, this invention directs itself to a composite laminate structure bonded to a portion of a fan blade for substantially preventing erosion and subsequent structural damage. More in particular, this invention pertains to fan blade protection systems having an outer erosion resistant metallic layer bonded to an elastomeric energy dissipative layer. Further, this invention directs itself to composite laminate fan blade protection systems having a metallic outer layer of predetermined yield strength and predetermined thickness, to elastically deform responsive to particulate impingement, and be manually formable about the leading edge of the fan blade.

2. Prior Art

Fan blade protection systems are well-known in the art, as the problem of particulate erosion on fiber reinforced plastic blades is equally well-known. The most common particulates responsible for erosion damage to aerodynamic surfaces are water droplets. The erosion damage caused by water droplets is made up of two components: the first component is a depression formed by the direct impact of the droplet on the surface. The second component involves the deformation and flowing of the droplet itself as it moves out across the surface of the fan blade. These two components interact and result in a maximum pressure that occurs in a ring around the center of the initial impact point. The maximum pressure can be a factor of three times as great as the water hammering pressure. For non-metallic fan blades, the erosion takes the form of an initial surface depression with upraised edges. The edges can then be eroded away by the outflowing water from the droplet. Eventually, this action causes breaking of the underlying structural fibers which in turn leads to blade failure.

The best prior art known to the Applicants include U.S. Pat. Nos. 4,097,193; 4,667,906; 3,825,371; 4,318,672; 3,999,888; 3,689,178; 4,565,495; 4,342,542; 4,121,894; 4,671,471; 4,010,530; 3,859,005; 4,006,999; and, 2,767,436.

Some prior art such as that shown in U.S. Pat. Nos. 4,342,542; 4,318,672; 3,999,888; 4,006,999; 4,565,495; and, 3,825,371 are directed to fan blade protective systems which make use of metallic caps which may be secured releasably or fixably to the fan blade. The metallic caps protect the blade by absorbing the energy of impact and bending, the bending being resisted by the modulus of the steel, and the supporting substrate. The substrate can therefore still be damaged by the initial impact but is protected from the erosion effect of the flowing water.

Other prior art systems use elastomeric coatings which may be applied in the form of paints or pastes. Elastomeric coatings protect the blade by compressing and absorbing the energy of impact, but then the elastomeric surface is subject to erosion by the drop as it flows out across the surface. Typical materials used for these coatings are urethanes and neoprene rubber. However, these protecting coatings do not last very long, and are difficult to apply in the thicknesses required to be protective.

In other prior art systems such as U.S. Pat. No. 4,667,906, there are provided a replaceable tip for the leading edge of an aircraft comprising an abrasion shield fixably attached to a resilient cushion insert, spaced from the leading edge of the aircraft by a shim. The resilient cushion insert forms a damping arrangement for reducing damage to the aircraft leading edge when the replaceable leading edge tip is impacted. However, the metallic abrasion shield is not formed of a material having a high yield strength, since it is the design intent that the abrasion shield permanently deform on impact, and is therefore made replaceable. In addition, the resilient cushion insert is formed of a material having a very high spring rate, and therefore being relatively stiff deforms plastically rather than elastically. Further, this system does not comprise a composite laminate structure where both the abrasion shield and resilient insert cover a portion of the leading edge of the aerodynamic surface, as provided by the instant invention.

SUMMARY OF THE INVENTION

A fan blade protection system secured to a fan blade for substantially preventing erosion by particulate impingement of the fan blade. The fan blade protection system is formed by a composite laminate structure bonded to at least a portion of the external surface of the fan blade. The composite laminate structure includes an abrasion resistant metallic outer layer bonded to an elastomeric energy dissipative layer. The metallic outer layer is composed of a material having a predetermined yield strength and having a predetermined thickness to elastically deform in response to impingement by particulates, and be manually formable about the leading edge of the fan blade.

DESCRIPTION OF THE PREFERRED EMBODIMENTS

Figure 1:
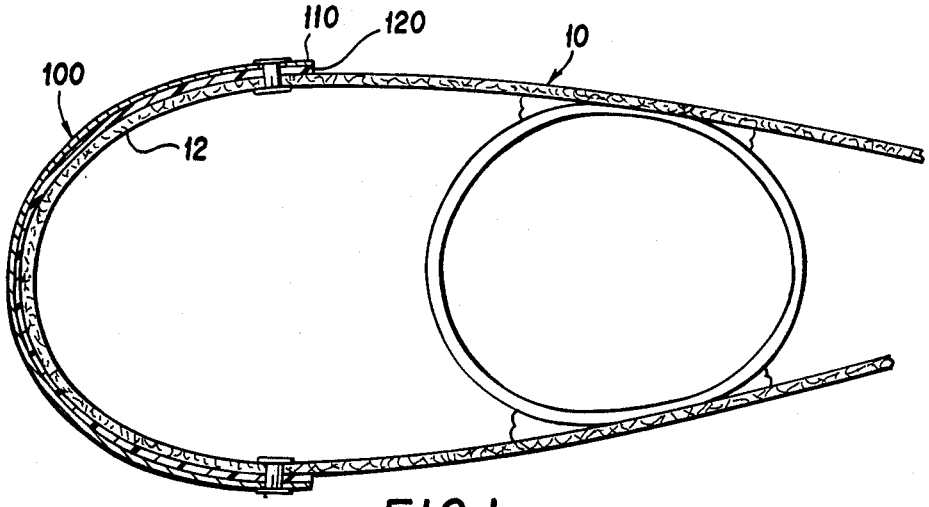
FIG. 1 is a sectional view of the fan blade protection system.
Figure 2:
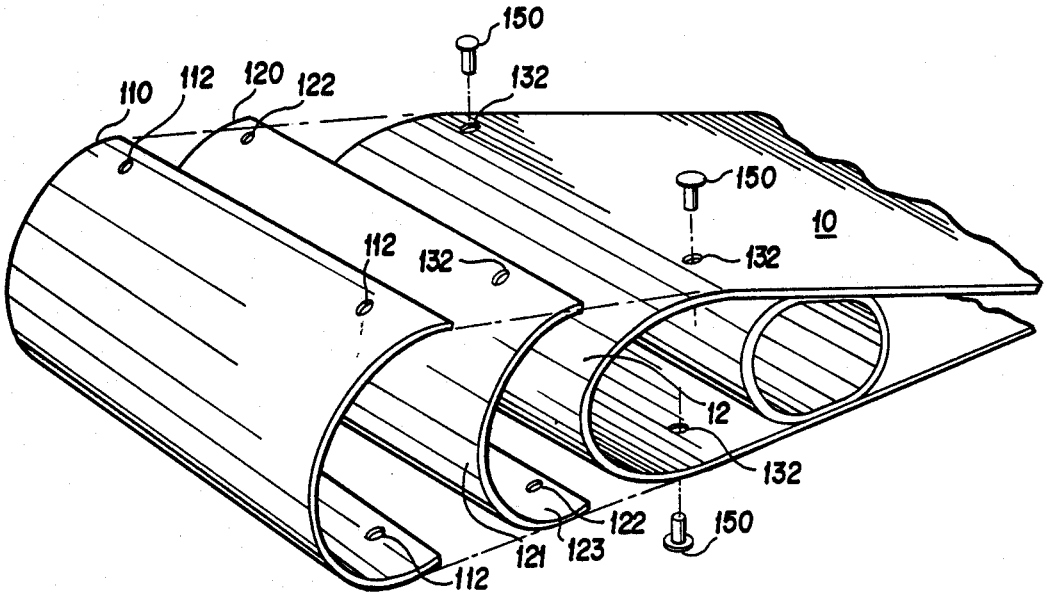
FIG. 2 is an exploded perspective view of the fan blade protection system.
Figure 3:
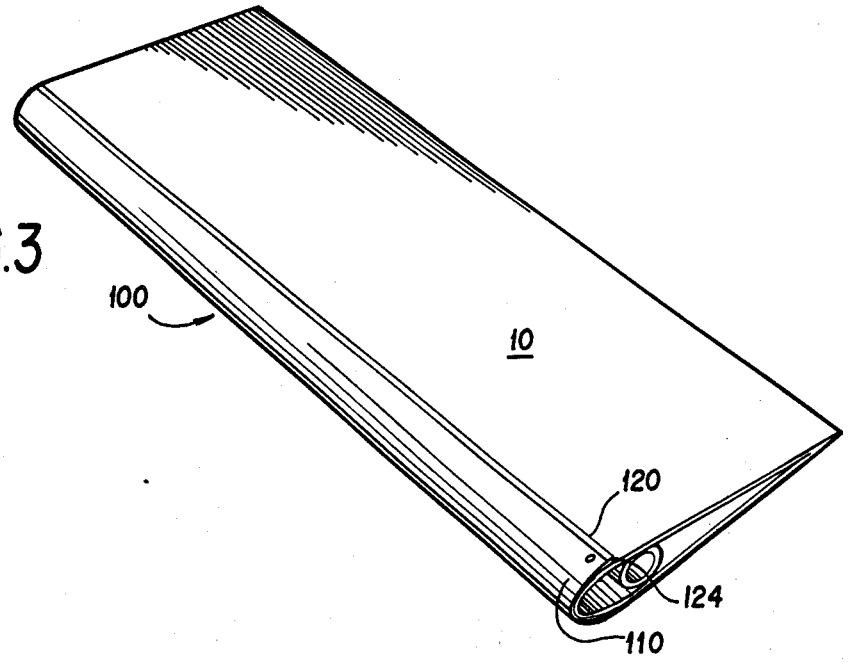
FIG. 3 is a perspective view of an ultimate embodiment of the fan blade protection system.

Referring to FIGS. 1-3, there is shown fan blade protection system 100 laminately bonded to a fan blade 10. As will be seen in following paragraphs, fan blade protection system 100 is specifically directed to substantially preventing erosion by particulate impingement on fan blade 10. Although not restricted to use with fan blades of composite plastic composition, fan blade protection system 100 is particularly useful in protecting aerodynamic surfaces formed with Fiberglas reinforced plastic-like materials. Additionally, fan blade protection system 100 has been designed to facilitate field application of fan blade protection system 100 to fan blade systems already in service.

Composite fan blade 10 is typically formed from a laminate structure comprising layers of Fiberglas and a thermoset resin to form a high strength, lightweight, and inexpensive fan element. To a portion 12 of fan blade 10 the composite laminate structure of fan blade protection system 100 is added, as shown in FIG. 1. The composite laminate structure of fan blade protection system 100 comprises an erosion resistant outer layer 110 bonded to an elastomeric energy dissipative layer 120, the combination bonded to the outer surface of fan blade portion 12.

As shown in the exploded view of FIG. 2, elastomeric energy dissipative layer 120 includes opposing surfaces 121 and 123, both of which having a pressure-sensitive adhesive coating for bonding to impact of erosion-resistant layer 110 and the outer surface of fan blade portion 12, respectively. For some fan systems using fan blade protection system 100, an addition to the adhesive bonding is utilized to laminate impact or erosion resistant layer 110 and energy dissipative layer 120 to the fan blade portion 12. In these embodiments, a plurality of rivet type fasteners 150 are added through the plurality of the overlapping openings 112, 122, and 132. This additional fastening means adds an extra measure of safety, to insure that the fan blade protection system 100 will remain fixably coupled to fan blade 10 throughout its operable life.

Fan blade 10 represents a typical Fiberglas reinforced plastic blade used in fans having diameters which may range from 7 feet to 40 feet. Such fans are typically utilized in commercial water cooling towers, condensers, heat exchangers, and ventilation systems. Particulate impingement of the fan blades in these systems is predominantly in the form of water droplets. These droplets may have diameters which range in size up to 0.125 inches and impact the surface of the blade at a relative velocity in the order of 140 mph. As a means of protecting fan blade 10 from damage, the outer layer 110 must elastically deform upon impact with a high velocity water droplet. The energy transferred to outer layer 110 can then be dispensed over a large area of fan blade 10 by the elastomeric layer 120. To elastically deform under this impact load, the outer layer of fan blade protection system 100 would require a minimum yield strength of 57,000 psi (pounds per square inch). From this minimum yield strength it is calculated that erosion resistant member 110 must have a yield strength of at least 190,000 psi to provide an adequate safety factor.

To meet the requirement for high corrosion resistance and high yield strength, impact resistant member 110 is formed from 300 series stainless steel. The yield strength of 300 series stainless steels are sufficient to allow erosion resistant member 110 to have a minimum thickness of 0.002". The maximum thickness for erosion resistant member 110 is determined by the hand formability of the material. This maximum thickness has been determined empirically to be 0.004". In one working embodiment, erosion resistant member 110 formed from 304 stainless steel having a thickness of 0.003" has been successfully used.

Figure 6:
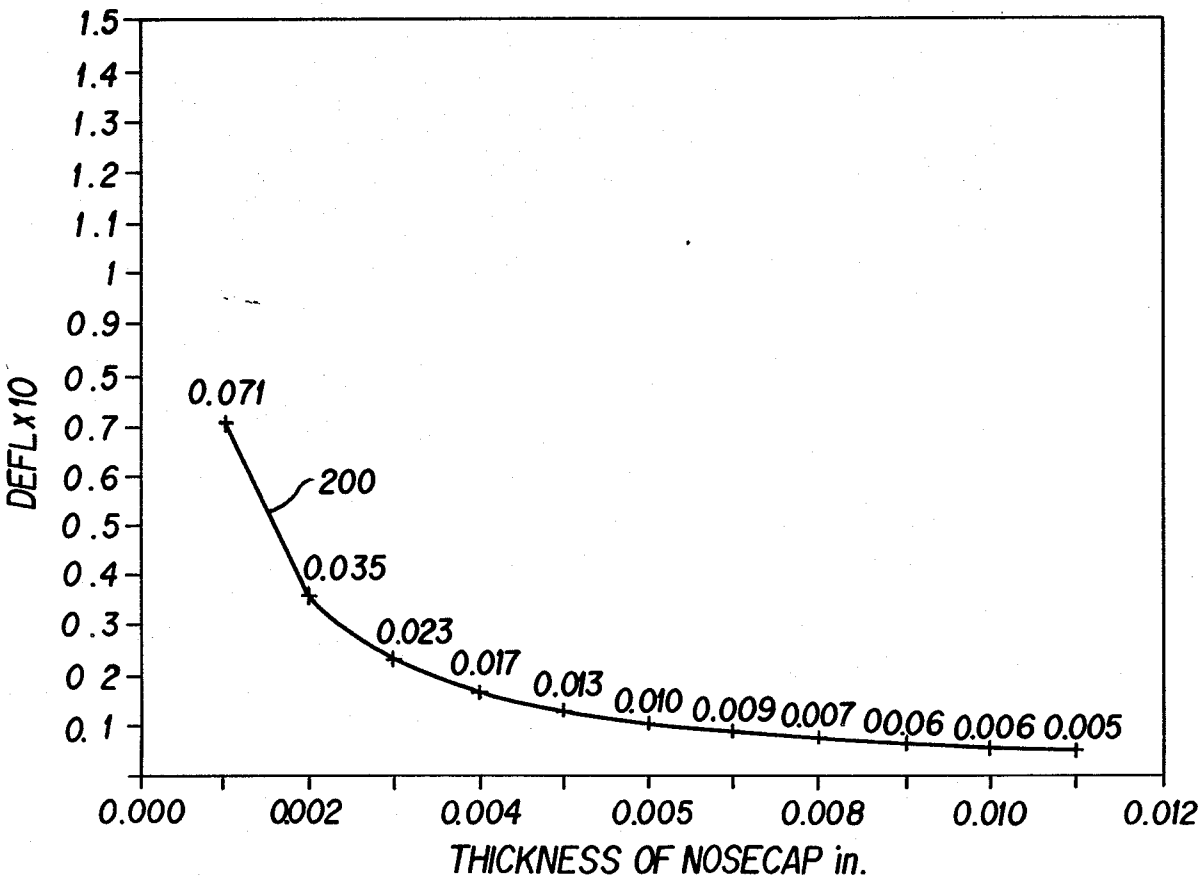
FIG. 6 is a graph representing deflection of the outer impact resisting layer relative to impact force vs. material thickness; and, FIG. 7 is a graphical representation of force vs. spring rate for the energy dissipative layer.

Referring to FIG. 6, there is shown a graph of deflection vs. thickness of the 304 stainless steel erosion resistant layer, when impacted by a 0.125" water droplet at 140 mph. Graph line 200 clearly shows the deflection dropping drastically between material thicknesses of 0.001" and 0.002", with less drastic deflection between 0.002" and 0.004", and further flattening out for thicknesses above 0.004". Therefore, hand forming does not create and design limitations on erosion resistant member 110, as thicker materials which would require other methods of application would not provide significant advantages to the functioning of fan blade protection system 100.

The metallic erosion resistant member 110 elastically deforms when impacted by high velocity water droplets and then springs back to its original position, its yield point not having been reached. As shown by graph line 200, a 140 mph water droplet causes the stainless steel outer layer to deflect 0.023 inches. Obviously, the outer layer 110 must be spaced at least that distance from the fan blade surface to prevent the total force of the impact from being transmitted directly to the blade surface at the point of impact. Because the impact area is small and the impact force over a greater surface area to prevent damage to the Fiberglas fibers of the composite fan blade structure.

Figure 7:
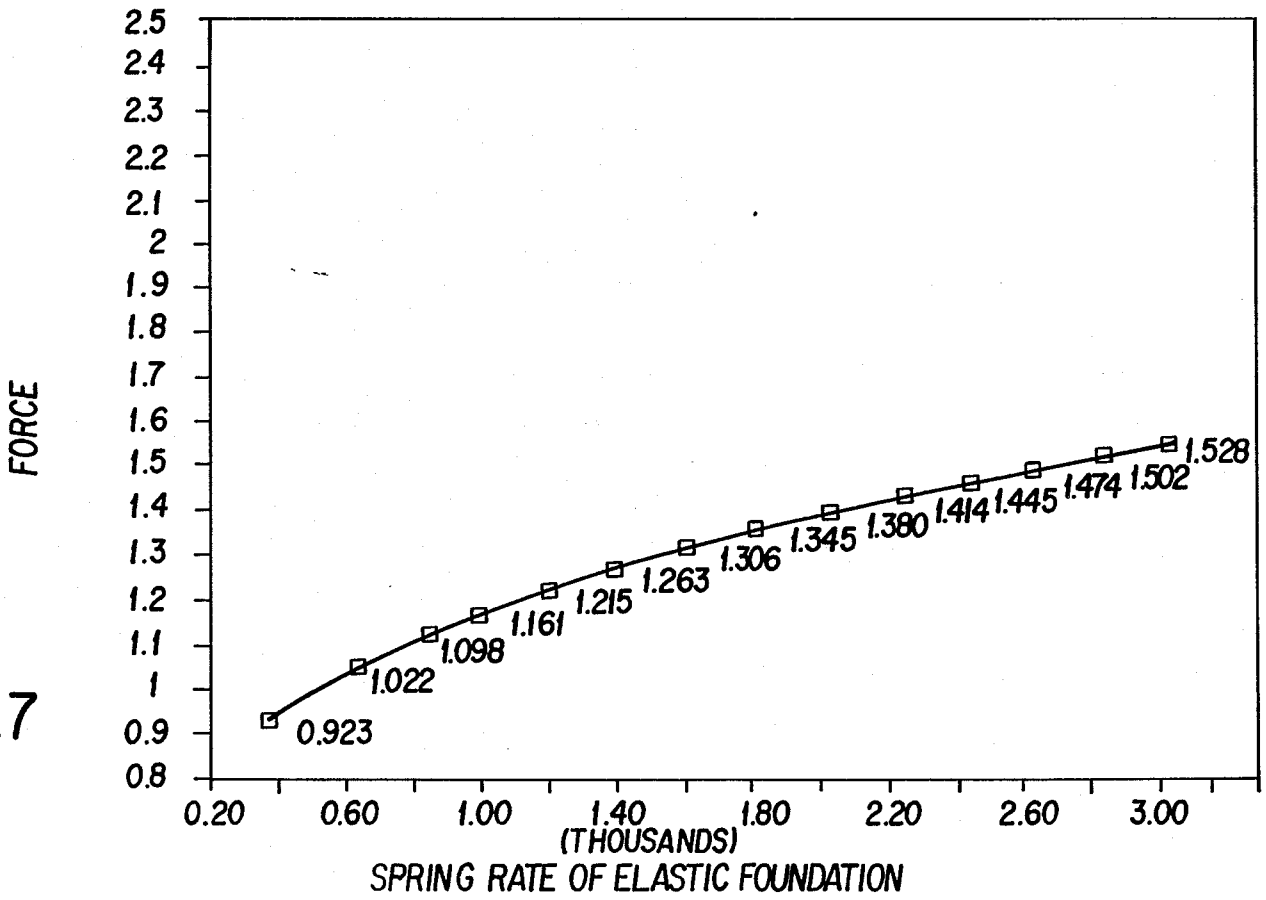

In order to spread the impact force sufficiently, the compressibility of the elastomeric energy dissipative layer must be studied. Referring to FIG. 7, graph line 300 represents the change in force vs. compressibility for the energy dissipative layer bonded to a 0.003" thick impact resistant member when impacted by a 140 mph 0.125 inch water droplet. As shown, the force increases almost linearly as the stiffness of the elastic foundation increases. It is therefore desirable to select an elastomeric material with a low spring rate so as to deliver the smallest possible force to any point on the surface of the blade. In one working embodiment, an energy dissipative layer having a spring rate in the range of 430–400 pounds per inch squared per inch, and a thickness approximating 0.045 inches has been successfully used. One such elastomeric energy dissipative layer material is commercially available from Adhesives Research, Inc. of Glenrock, Pa., having the designation AR-5500.

As a system, the metallic impact resistant member 110 elastically deforms on impact, spreading the impact energy over the area of deformation, which is larger than the impacting droplet. The elastomeric energy dissipative member 120 distributes the impact forces over an even larger area and dissipates a portion of the energy by means of its elastic compression. Thus, the force transferred to the surface of fan blade 10 is spread over a large area and sufficiently low to not cause damage to the blade structure.

The elastomeric energy dissipative layer 120 is fabricated in the form of a double-coated foam bonding tape having an acrylic polymer adhesive or other environmentally resistant adhesive for bonding the composite structure of fan blade protection system 100 to fan blade 10.

The method of assembly of fan blade protection system 100 to fan blade 10 is relatively simple and straight forward, easily carried out in both manufacturing and repair environments. The stainless steel foil 110 is overlaid on the elastomeric bonding tape surface 121 and pressed in contiguous contact therewith. The pressure applied to the foil 110 as it is applied to the bonding tape surface 121 activates the adhesive for bonding each to the other. The laminated structure of the metallic coil 110 and the elastomeric tape 130 is then bonded to the prepared fan blade portion 12, which is typically the leading edge of the aerodynamic fan blade 10.

Before the laminated structure 100 is applied to the leading edge 12 of fan blade 10, the fan blade is cleaned with a solvent to remove any contaminants which would otherwise prevent a good adhesive bond. Foam bonding tape 120 typically is fabricated with a removable liner over one adhesive surface, such as surface 123, which is removed prior to contact with the surface to which the tape is to be bonded. With this protective liner removed, a portion of the adhesively coated elastomeric tape surface 123 is pressed in contiguous contact with either the upper or lower exterior surface of leading edge 12. The remainder of the unadhered laminate structure 100 is then hand formed around the arcuate surface of leading edge 12 from one end of the blade to the other.

In an alternate embodiment, fan blade protection system 100 is secured to fan blade 10 by both adhesive bonding with an elastomeric tape 120 having adhesive on surfaces 121 and 123, in combination with the addition of fasteners 150. This redundant system for coupling the laminate structure 100 to fan blade 10 may be utilized where high reliability and a long service life in a hostile environment is required. Fasteners 150 may be a 5 mm nylon rivet which secures fan blade protection system 100 to fan blade 10 through a series of overlaying apertures 112, 122, and 132. Apertures 112, 122, and 132 in erosion resistant member 110, elastomeric tape 120, and fan blade 10 respectively may be either preformed prior to assembly or subsequent thereto.

Non-metallic fan blades have found extensive use in fan systems which operate in corrosive environments. However, these fan blades are subject to erosion from impingement by particulates. These particulates in the form of water droplets, dust, and dirt, impact the blade, causing surface damage and eventually cause the underlying structural fibers to break, which leads to blade failure. Protection from this failure mechanism must not interfere with the aerodynamics of the fan blade nor significantly affect the fan's weight, so as not to adversely affect the fan system performance. Fan blade protection system 100 meets these requirements with a laminate structure comprising a metallic impact resistant member 110 bonded to an elastomeric energy dissipative member 120, this combination being bonded to the leading edge 12 of fan blade 10. The functioning of fan blade protection system 100 depends critically on the design parameters for each of the materials in the laminate structure.

Thus, the erosion resistant layer 110 in addition to being lightweight, corrosion resistant, and hand formable, must be of high yield strength. To function properly, the erosion resistant layer 110 must elastically deform during the expected worst cause particulate impingement. Therefore, a material having a yield strength of at least 190,000 psi is critical to the proper functioning of fan blade protection system 100.

It is further critical that the erosion resistant layer 110 be separated from the fan blade surface by an energy dissipative layer 120, meeting several critical design parameters as well. Energy dissipative layer 120 must be sufficiently thick to prevent contact between the impact resistant layer 110 and the fan blade surface during deformation caused by particulate impingement. However, layer 120 cannot be too thick, so as to disturb the aerodynamics of the fan blade to which it is bonded. The spring rate of the elastic energy dissipative layer 120 is another characteristic critical to the functioning of fan blade protection system 100. Energy dissipative layer 120 must have a spring rate and thickness which provides sufficient resistance to deformation to prevent contact between erosion resistant layer 110 and the blade surface while dissipating and distributing the impact forces from the small area of impingement to a large fan blade surface area. For one working embodiment, these critical requirements have been met by a copolymer foam having an approximate thickness of 0.045 inches with a spring rate having an approximating range of 430–440 psi.

Although not important to the inventive concept, energy dissipative layer 120 may be provided as a foam tape, adhesively coated on one or both surfaces to facilitate assembly of the laminate structure and bonding of that structure to the fan blade. However, obviously, a bonding agent could be separately applied to the erosion resistant member 110 or the energy dissipative member 120 as well as between the laminate structure 100 and fan blade 10, at the time of assembly.

When fan blade protection system 100 is applied to fan systems which require maintenance personnel to handle the protected fan blades, such as during routine cleaning, then it is necessary to prevent contact with the thin metallic edge of impact resistant member 110. As shown in the embodiment of FIG. 3, contact with the edge of metallic impact resistant member 110 is prevented by an extension 124 of energy dissipative member 120. During contact between maintenance personnel and fan blade protection system 100, metallic impact resistant member 110 deforms, the edge being displaced below the surface of extension 124. When maintenance personnel are in transverse sliding contact with the laminate structure of system 100, a portion of extension 124, in shear, elastically displaces to cover the edge of metallic impact resistant member 110.

Figure 3A:
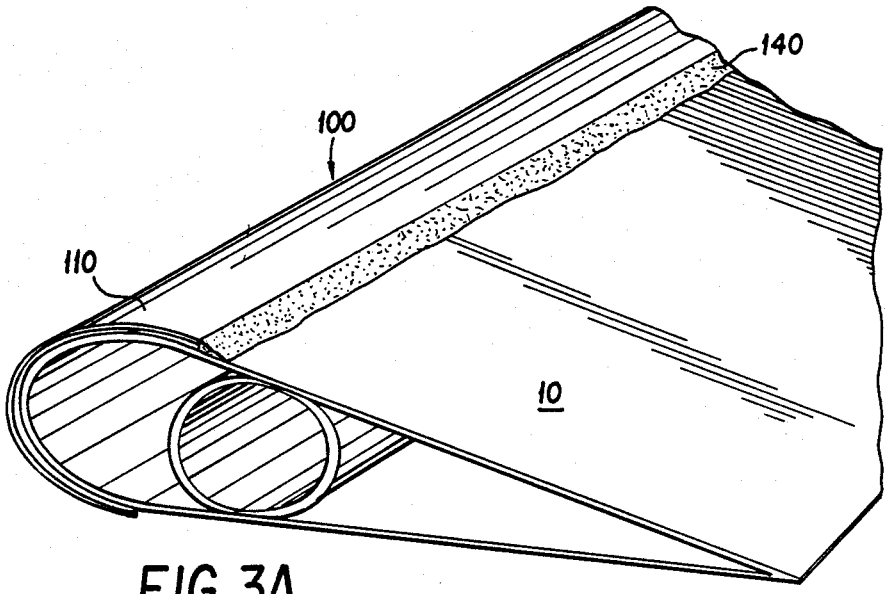
FIG. 3A is another alternate embodiment of the fan blade protection system.

Referring now to FIG. 3A, there is shown an alternate embodiment for fan blade protection system 100 wherein the terminating edge of the laminate structure is provided with a fillet 140 of caulking material, such as a silicone adhesive/sealant. Fillet 140 serves to prevent injurious contact by maintenance personnel with the thin metallic edge of impact resistant member 110. Additionally, fillet 140 provides a smooth transition between the outer surface of fan blade protection system 100 and the surface of fan blade 10.

The large fan blades to which fan blade protection system 100 is applied have complex aerodynamic shapes. Typically, the blades change in pitch as a function of their radial distance along the length of the blade. Thus, the leading edge of the blade tends to have a helical twist to which fan blade protection system 100 must conform.

Figure 4:
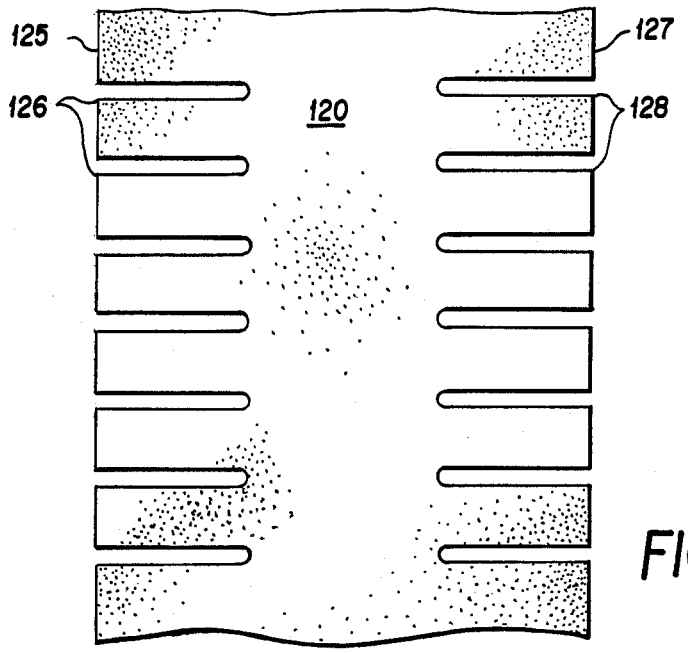
FIG. 4 is a plan view of one embodiment of the energy dissipative layer for the fan blade protection system.

Forming fan blade protection system 100 to this contour is difficult, as the elastomeric energy dissipation layer 120 tends to bunch up creating a wrinkle in the metallic erosion resistant layer 110. To overcome this problem, elastomeric energy absorbing member 120 may be provided with a plurality of uniformly spaced slits, as shown in FIG. 4. The plurality of slits 126 extend from the longitudinal edge 125 of layer 120 a predetermined distance toward the opposing edge 127. Similarly, a plurality of uniformly spaced slits 128 extend from the longitudinal edge 127 a predetermined distance toward the opposing edge 125. Each of slits 126 or 128 may extend a dimension up to approximately one-third the distance between edges 125 and 127. As shown in the FIG., slits 126 and 128 are longitudinally aligned and equally spaced across the length of layer 120.

Figure 5:
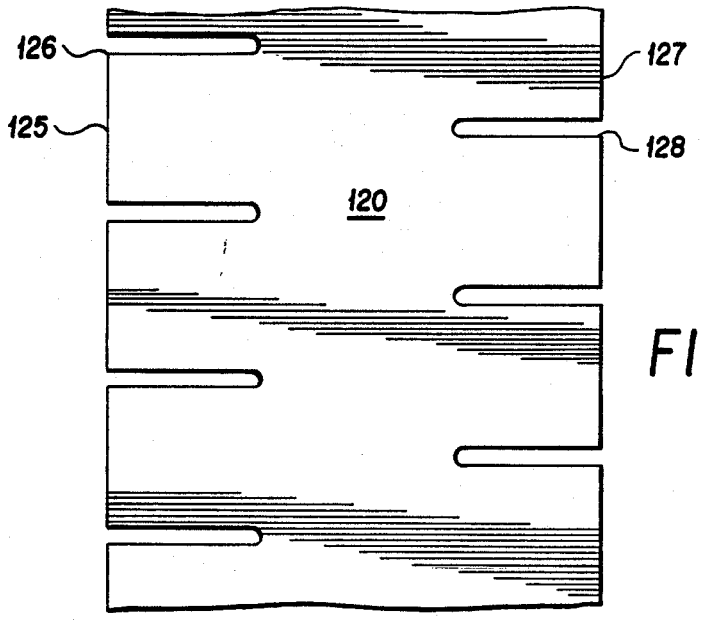
FIG. 5 is another embodiment of the energy dissipative layer for the fan blade protection system.

FIG. 5 shows an alternate embodiment for layer 120 wherein the slits 126 and 128 are provided in a longitudinally staggered relationship. In this arrangement, slits 126 and 128 may extend from longitudinal edges 125 and 127, respectively, a greater distance than possible with the embodiment of FIG. 4.

Slits 126 and 128 may extend a dimension equal to approximately two-thirds the distance between edges 125 and 127. The slits provided in the embodiments of FIG. 4 and FIG. 5 provide sufficient space to allow the necessary material displacement required for contiguous interface between fan blade protection system 100 and the longitudinal contour of fan blade 10 without causing creasing or buckling of any portion of fan blade protection system 100.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A fan blade protection system secured to a fan blade formed from resinous matrix material for substantially preventing erosion by particulate impingement on said fan blade, comprising:

a composite laminate structure bonded to at least a portion of an external surface of said fan blade having an aerodynamic contour devoid of recesses having an erosion resistant metallic outer layer bonded to an elastomeric energy dissipative layer, said composite laminate structure being riveted to said fan blade in addition to said bonding, said metallic outer layer being of predetermined yield strength and having a predetermined thickness to (1) elastically deform responsive to said impingement by said particulates, and (2) by manually formable about a leading edge of said fan blade where said elastomeric layer being of predetermined spring rate and having a predetermined thickness for substantially preventing said metallic outer layer from contacting said fan blade external surface during said elastic deformation of said metallic outer layer responsive to said impingement by said particulates.

2. The fan blade protection system as recited in claim 1 where said metallic outer layer has a yield strength greater than 57,000 psi.

3. The fan blade protection system as recited in claim 1 where said metallic outer layer has an approximating thickness in the range of 0.002 to 0.004 inches.

4. The fan blade protection system as recited in claim 1 where said elastomeric layer has an approximating spring rate in the range of 430 to 440 pounds per square inch squared per inch.

5. The fan blade protection system as recited in claim 4 where said elastomeric layer has a thickness approximating 0.045 inches.

6. The fan blade protection system as recited in claim 5 where said elastomeric layer has formed therein a plurality of uniformly spaced slits of predetermined length, said slits extending from opposing longitudinal edges of said elastomeric layer for preventing creasing of said composite laminate structure during said bonding to said external surface of said fan blade.

7. The fan blade protection system as recited in claim 6 where said slits extending from opposing sides of said elastomeric layer are formed in longitudinally aligned pairs.

8. The fan blade protection system as recited in claim 6 where said slits extending from opposing sides of said elastomeric layer are in a longitudinally staggered relationship.

9. The fan blade protection system as recited in claim 1 where said metallic outer layer having a predetermined width dimension smaller than a predetermined width dimension of said elastomeric energy dissipative layer for permitting a portion of said elastomeric energy dissipative layer to extend beyond said metallic outer layer, said elastomeric energy dissipative layer extending beyond said metallic layer a distance sufficient to substantially prevent any external contact with an edge portion of said metallic layer.

10. The fan blade protection system as recited in claim 1 where said composite laminate structure includes a pair of elastomeric fillets on opposing longitudinal edges of said composite laminate structure for providing a smooth surface transition between said composite laminate structure and said external surfaced of said fan blade, said composite laminate structure being disposed above said external surface of said fan blade.

11. A laminate nose cap for protecting a resinous composite fan blade from erosion caused by impingement of high relative velocity liquid droplets, comprising:

an erosion resisting member defining an outer layer of said laminate nose cap, said erosion resisting member being formed from a material composition having a predetermined yield strength for (1) elastically deforming responsive to said impingement by said liquid droplets, and (2) allowing said erosion resisting member to have a sufficiently thin predetermined material thickness for manual formability about at least a portion of said fan blade having an aerodynamic contour devoid of recesses; and, an elastomeric bonding tape having a pair of opposing surfaces adhesively coated for (1) laminately bonding said impact resisting member to a portion of an external surface of said fan blade, and (2) providing an energy dissipative layer intermediate said impact resisting member and said fan blade, said laminate nose cap being riveted to said fan blade in addition to said laminate bonding where said elastomeric bonding tape being of predetermined spring rate and having a predetermined thickness for substantially preventing said impact resisting member from contacting an external surface of said fan blade during said elastic deformation of said impact resistant member responsive to said impingement by said liquid droplets.

12. The laminate nose cap as recited in claim 11 where said impact resisting member has a yield strength greater than 57,000 psi.

13. The laminate nose cap as recited in claim 11 where said impact resisting member has an approximating thickness in the range of 0.002 to 0.004 inches.

14. The laminate nose cap as recited in claim 11 where said elastomeric bonding tape has an approximating spring rate in the range of 430 to 440 pounds per inch squared per inch.

15. The laminate nose cap as recited in claim 14 where said elastomeric bonding tape has a thickness approximating 0.045 inches.

16. The laminate nose cap as recited in claim 15 said elastomeric bonding tape has formed therein a plurality of uniformly spaced slits of predetermined length, said slits extending from opposing longitudinal edges of elastomeric bonding tape for preventing creasing of said laminate nose cap during said laminate bonding of said impact resisting member to said external surface of said fan blade.

17. The laminate nose cap as recited in claim 16 where said slits extending from opposing sides of said elastomeric bonding tape are formed in longitudinally aligned pairs.

18. The laminate nose cap as recited in claim 16 where said slits extending from opposing sides of said elastomeric bonding tape are in a longitudinally staggered relationship.

19. The laminate nose cap as recited in claim 11 where said impact resisting member having a predetermined width dimension smaller than a predetermined width dimension of said elastomeric bonding tape to extend beyond said impact resisting member, said extension of said elastomeric bonding tape being sufficient to substantially prevent any external contact with an edge portion of said erosion resisting member.

20. The laminate nose cap as recited in claim 11 where said laminate nose cap includes a pair of elastomeric fillets on opposing longitudinal edges of said nose cap for providing a smooth surface transition between said laminate nose cap and said external surface of said fan blade, said laminate nose cap being disposed above said external surface of said fan blade.

* * * * *